US005763840A

United States Patent [19]

Liao

[11] Patent Number: 5,763,840

[45] Date of Patent: Jun. 9, 1998

[54] MEMBRANE SWITCH WITH IMPROVED ACTUATION SENSITIVITY

[75] Inventor: Pin-Chien Liao, Taoyuan, Taiwan

[73] Assignee: Acer Pheripherals, Inc., Taoyuan, Taiwan

[21] Appl. No.: 645,060

[22] Filed: May 13, 1996

[51] Int. Cl.[6] ..... H01H 13/70

[52] U.S. Cl. ..... 200/5 A; 200/292; 200/512; 340/665

[58] Field of Search ..... 178/18; 29/622; 427/58, 96; 340/626, 665, 666; 200/5 A, 85 R, 86 R, 292, 512, 515–517

[56] References Cited

U.S. PATENT DOCUMENTS

| | | | |
|---|---|---|---|
| 4,017,697 | 4/1977 | Larson | 200/5 A |
| 4,391,845 | 7/1983 | Denley | 427/58 |
| 4,818,827 | 4/1989 | Ipcinski | 200/512 |
| 5,588,673 | 12/1996 | Green | 200/5 A |

*Primary Examiner*—Gerald P. Tolin

*Attorney, Agent, or Firm*—Meltzer, Lippe, Goldstein, et al.

[57] ABSTRACT

A membrane switch including a plurality of upper dot-pads and a plurality of lower dot-pads is provided to enhance the operational sensitivity while avoiding unexpexted actuation of membrane switch is provided. The plurality of upper dot-pads are provided during the print process of the top switch-pad and distributed to surround the top switch-pad. A plurality of lower dot-pads corresponding the plurality of upper dot-pads are provided during the print process of the bottom switch-pad and distributed to surround the bottom switch-pad. Each of the plurality of upper dot-pads has a lower-edge and each of the plurality of lower dot-pads has an upper-edge. As the top membrane is free of an external force, the lower-edge of top switch-pad is spaced from the upper-edge of bottom switch-pad by a first dimension greater than a second dimension by which the lower-edge of each upper dot-pad is spaced from the upper-edge of each lower dot-pad. The top switch-pad contacts with the bottom switch-pad following the contact of the plurality of upper dot-pads with the plurality of corresponding lower dot-pads as the top membrane is deformed by the external force thereby making a better actuation sensitivity of the membrane switch.

4 Claims, 2 Drawing Sheets

MEMBRANE SWITCH WITH IMPROVED ACTUATION SENSITIVITY

TECHNICAL FIELD OF INVENTION

The invention relates to a membrane switch with improved actuation sensitivity.

BACKGROUND OF INVENTION

The membrane switch has been widely used in the input device of electrical instruments, e.g. keyboard of portable personal computer. The conventional membrane switch, as shown in FIG. 1, includes a top membrane 11, a bottom membrane 13, a spacer 12, a top switch-pad 111 and a bottom switch-pad 131. As an external force is applied on the top membrane 11 causing its downward deformation, the top switch-pad 111 contacts with the bottom switch-pad 131 thereby turning ON the membrane switch. The inner space defined by the top membrane 11, the bottom membrane 13 and the spacer 12 is the spacer hole. Mylar is the commercial name of the polymer material used as the top membrane 11 or the bottom membrane 13 which is well known to persons skilled in arts.

To enhance the operational sensitivity of the membrane switch, typically, designer would choose to either decrease the thickness of the spacer 12 or increase the diameter of the spacer hole. However, those approaches at times create problems of instability phenomenon or unexpected actuation of switch due to an extreme sensitivity of the switch under higher or lower temperature environments than that of design.

To resolve the problem mentioned above, the membrane switch of the invention provides an expected high operational sensitivity and stability at the same time without additional production process.

SUMMARY OF INVENTION

In one embodiment, the membrane switch includes a spacer. A plurality of upper dot-pads are provided during the print process of the top switch-pad and distributed to surround the top switch-pad, and a plurality of lower dot-pads corresponding to the plurality of upper dot-pads are provided during the print process of the bottom switch-pad and distributed to surround the bottom switch-pad. Each of the plurality of upper dot-pads has a lower-edge and each of the plurality of lower dot-pads has an upper-edge. As the top membrane is free of an external force, the lower-edge of the top switch-pad is spaced from the upper-edge of the bottom switch-pad by a first dimension. The lower-edge of each upper dot-pad is spaced from the upper-edge of each lower dot-pad by a second dimension. The first dimension is substantially greater than the second dimension. The top switch-pad contacts with the corresponding bottom switch-pad following the contact of the plurality of upper dot-pads with the plurality of lower dot-pads as the top membrane is deformed by the external force thereby making a better actuation sensitivity of the membrane switch.

In another embodiment, the membrane switch does not have a spacer. A plurality of upper dot-pads are provided during the print process of the top switch-pad and distributed to surround the top switch-pad and a plurality of lower dot-pads corresponding to the plurality of upper dot-pads are provided during the print process of the bottom switch-pad and distributed to surround the bottom switch-pad. Each of the plurality of upper dot-pads has a lower-edge and each of the plurality of lower dot-pads has an upper-edge. As the top membrane is free of an external force, the lower-edge of the top switch-pad is spaced from the upper-edge of the bottom switch-pad by a dimension and the lower-edge of each upper dot-pad is in contact with the upper-edge of each lower dot-pad. The top switch-pad contacts with the corresponding bottom switch-pad as the top membrane is deformed by the external force thereby making a better actuation sensitivity of the membrane switch.

DETAILED DESCRIPTIONS OF THE PREFERRED EMBODIMENT

Figure 1:
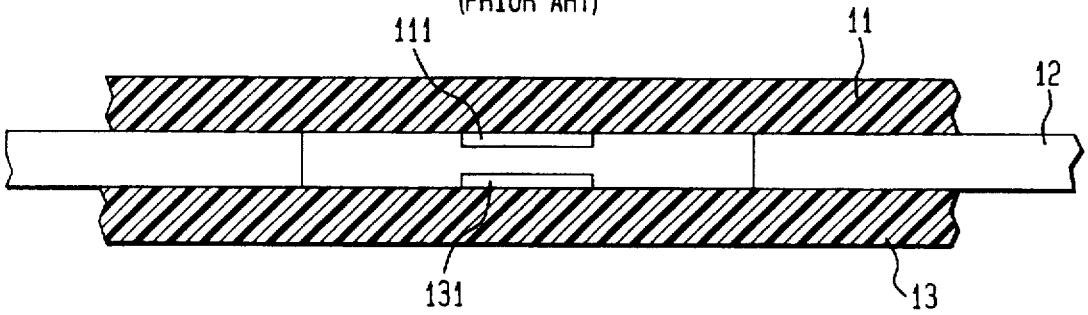
FIG. 1 (PRIOR ART)
FIG. 1 illustrates the sectional view of a conventional membrane switch.
Figure 2:
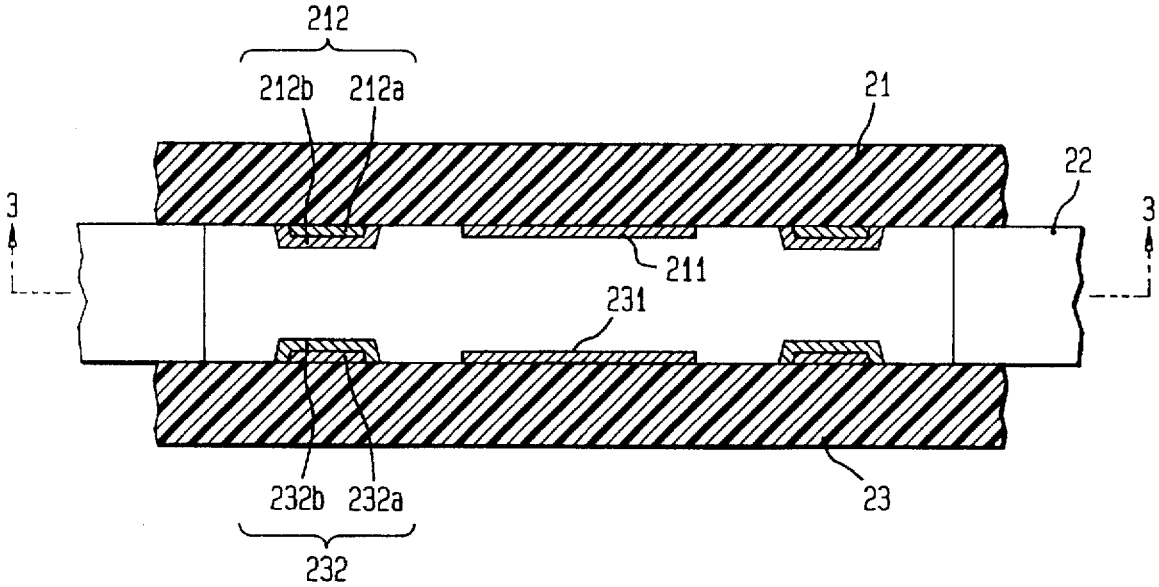
FIG. 2 illustrates one embodiment of the invention in sectional view.
Figure 3:
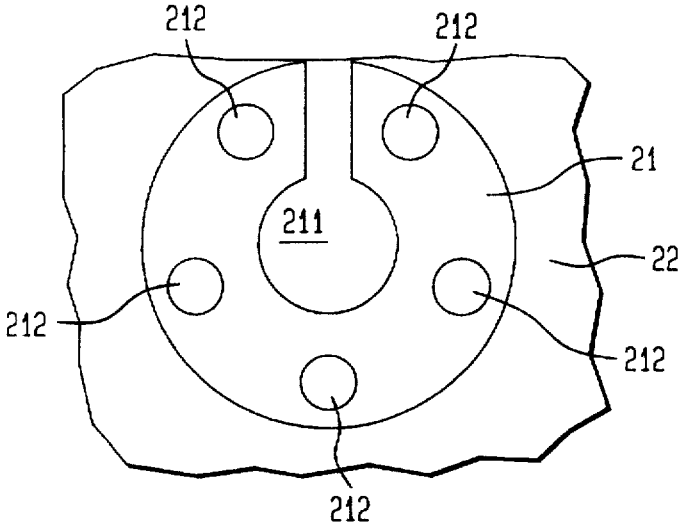
FIG. 3 illustrates the relationship between the top switch-pad and the plurality of the upper dot-pads.

As shown in FIG. 2, the membrane switch of the instant invention comprises a top membrane 21, a bottom membrane 23, a spacer 22, a top switch-pad 211 printed on the top membrane 21 and a bottom switch-pad 231 printed on the bottom membrane 23. A plurality of upper dot-pads 212 are provided during the print processes of the top switch-pad 211 and distributed to surround the top switch-pad 211, as shown in FIG. 3. A plurality of lower dot-pads 232 are provided during the print processes of the bottom switch-pad 231 and distributed to surround the bottom switch-pad 231. In particular, the dot-pads 212 or 232 are distributed the same way as the planets relative to the sun, which is clear from illustration of FIG. 3. Typically, the dimension of the top or bottom membranes varies from 0.04 mm to 0.110 mm.

The main function of the upper or lower dot-pads is to prohibit the unexpected actuation or instability of the membrane switch while achieving a high operational sensitivity of the switch. Therefore, from FIG. 2, it is shown the thickness of each dot-pad 212 is greater than that of the top switch-pad 211 and the thickness of each dot-pad 232 is greater than that of the bottom switch-pad 231. While the top membrane is deformed due to a force applied thereon, the upper dot-pads 212 contact with the corresponding bottom dot-pads 232 first, and, thereafter, the top switch-pad 211 contacts with the bottom switch-pad 231 thereby making a better actuation sensitivity of the membrane switch.

It is to be noted that arrangements other than that described above are within the spirit of the invention as long as the requirement of upper dot-pads 212 contacting with the corresponding bottom dot-pads 232 first, and, only thereafter, the top switch-pad 211 contacting with the bottom switch-pad 231 to turn ON the switch is met. For instance, the arrangement in which the lower-edge of top switch-pad 211 is spaced from the upper-edge of bottom switch-pad 231 by a first dimension greater than a second dimension by which the lower-edge of each upper dot-pad 212 is spaced from the upper-edge of each lower dot-pad 232 will achieve the object of the invention. As well known in the arts, the top or bottom switch-pads 211, 231 are layers of conductive material, i.e. silver, in paste form which are printed on the top or bottom membranes respectively first and then dried under an adequate temperature. The basic layers 212A, 232A shown are printed during the print process of the top or bottom membranes mentioned above thereby requiring no additional print process therefor.

The reinforced layer 212B or 232B are printed also during the production of the membrane switch which involves the print of conductive layer, i.e. silver, carbon layer or graphite layer, or non-conductive layer, i.e. di-electric paints, as well known in the arts. In particular, the production of finger array of the switches assembly needs a print process of carbon layer or graphite layer and, during the print process, the reinforced layers 212B and 232B are printed which requiring no additional process. To enhance the reliability, in typical, a layer of di-electric paint is usually provided on the top or bottom membrane to avoid short circuit between the printed circuits thereon, except areas of top switch-pad 211 and bottom switch-pad 231. Therefore, the reinforced layers 212B or 232B are printed during the print process of the di-electric paint.

Figure 4:
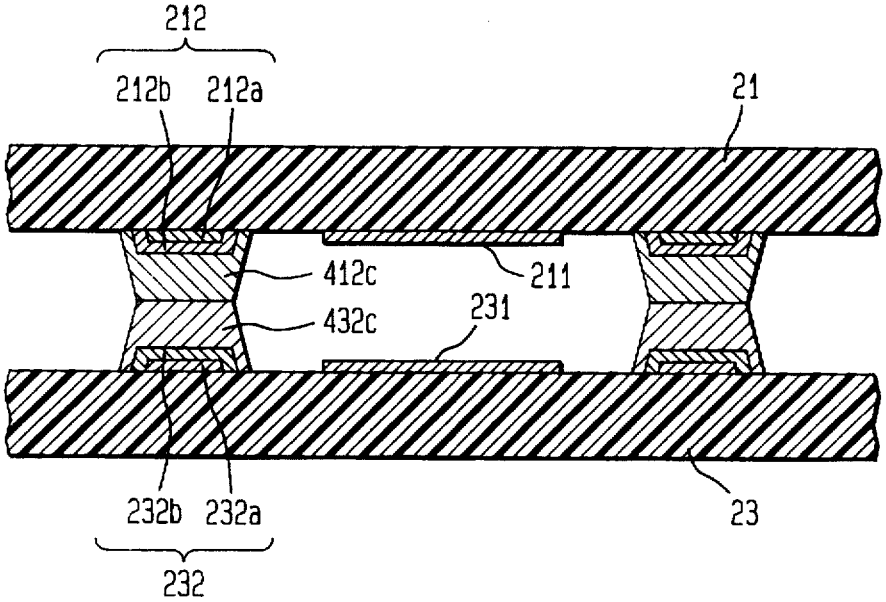
FIG. 4 illustrates second embodiment of the invention.

Compared to FIG. 2, another embodiment shown in FIG. 4 does not include the spacer the function of which is fulfilled by the switch-pad 212 and 232 along with layers 412C, 432C shown in FIG. 4. Same as upper or lower dot-pads, layers 412C, 432C are printed also during the print processes of the membrane switch which involves the print of conductive layer, i.e. silver, carbon layer or graphite layer, or non-conductive layer, i.e. di-electric paints.

What is claimed is:

1. A membrane switch assembly including a circuit trace and a di-electric painting thereon, comprising:

a top membrane having a bottom surface printed with a top switch-pad, the top switch-pad having a lower-edge;

a bottom membrane having a top surface printed with a bottom switch-pad corresponding to the top switch-pad, the membrane switch being ON as the top switch-pad contacts with the bottom switch-pad, the bottom switch-pad having an upper-edge;

an integral spacer sheet disposed between the top and bottom membrane for separating the top and bottom membranes such that the top switch-pad and bottom switch-pad are spaced apart when the top membrane is in an undepressed condition, the integral spacer sheet defining an aperture having a space for accommodating said top and bottom switch-pads;

wherein a plurality of upper dot-pads are distributed on the bottom surface of the top membrane and within the space of the aperture to surround the top switch-pad, a plurality of lower dot-pads corresponding to the plurality of upper dot-pads are distributed on the top surface of the bottom membrane and within the space of the aperture to surround the bottom switch-pad, the upper dot-pads and lower dot-pads are provided for preventing the membrane switch from being turned ON when the top membrane is depressed inadvertently, and the plurality of upper dot-pads are provided either during print process of the top switch-pad, the circuit trace or the di-electric painting, and the plurality of lower dot-pads are provided either during print process of the bottom switch-pad, the circuit trace or the di-electric painting, each of the plurality of upper dot-pads has a lower-edge, each of the plurality of lower dot-pads has an upper-edge, as the top membrane is free of an external force, the lower-edge of the top switch-pad is spaced from the upper-edge of the bottom switch-pad by a first dimension, the lower-edge of each upper dot-pad is spaced from the upper-edge of each corresponding lower dot-pad by a second dimension greater than zero, the first dimension is substantially greater than the second dimension, the top switch-pad contacts with the bottom switch-pad following the contact of the plurality of upper dot-pads with the plurality of lower dot-pads as the top membrane is deformed by the external force thereby making a better actuation sensitivity of the membrane switch.

2. The membrane switch assembly as recited in claim 1, wherein the print process includes print of a conductive layer, and the plurality of upper dot-pads and the plurality of lower dot-pads are printed during the print stage of conductive layer.

3. The membrane switch assembly as recited in claim 1, wherein the print process includes print of a conductive layer and a non-conductive layer, and the plurality of upper dot-pads and the plurality of lower dot-pads are printed during the print stage of conductive layer and non-conductive layer respectively.

4. The membrane switch assembly as recited in claim 1, wherein the print process includes print of a non-conductive layer, and the plurality of upper dot-pads and the plurality of lower dot-pads are printed during the print stage of non-conductive layer.

* * * * *